US007168175B1

(12) United States Patent
Cook

(10) Patent No.: US 7,168,175 B1
(45) Date of Patent: Jan. 30, 2007

(54) DECORATIVE FRAME MOLDING

(76) Inventor: Holly B. Cook, 117 Bayberry Ave., Egg Harbor Township, NJ (US) 08234

( * ) Notice: Subject to any disclaimer, the term of this patent is extended or adjusted under 35 U.S.C. 154(b) by 0 days.

(21) Appl. No.: 11/146,707

(22) Filed: Jun. 7, 2005

(51) Int. Cl.
*G01C 9/00* (2006.01)

(52) U.S. Cl. ..... 33/334; 33/613

(58) Field of Classification Search ..... 33/333, 33/334, 339, 347, 365, 369, 520, 644, 613
See application file for complete search history.

(56) References Cited

U.S. PATENT DOCUMENTS

| | | | | | |
|---|---|---|---|---|---|
| 815,570 | A * | 3/1906 | Vreeland | 33/339 |
| 1,236,743 | A * | 8/1917 | Morrow | 33/369 |
| 3,516,165 | A * | 6/1970 | Pfeffer | 33/520 |
| 5,758,858 | A * | 6/1998 | Barnes | 33/369 |
| 5,848,489 | A | 12/1998 | Hartley et al. | 33/333 |
| 6,138,369 | A | 10/2000 | Mushin | 33/333 |
| 6,324,767 | B1 * | 12/2001 | Houston | 33/365 |
| 6,409,870 | B1 | 6/2002 | Duffney | 156/256 |
| 6,617,005 | B2 | 9/2003 | Duffney | 428/138 |
| 6,849,320 | B2 | 2/2005 | Duffney | 428/139 |

* cited by examiner

*Primary Examiner*—Christopher W. Fulton
(74) *Attorney, Agent, or Firm*—Norman E. Lehrer

(57) ABSTRACT

A decorative frame molding includes a generally rectangular structure having a top, a bottom, a right side, a left side, a front side, and a back side. A recess is formed along the back side of the structure within which an adhesive may be placed in order to mount the frame molding to a flat surface. A removable level includes a first breakable length of material secured between the top and the bottom of the structure and a second breakable length of material secured between the right side and the left side of the structure. The lengths intersect at their respective centers. The first and second lengths of material of the level are made from a thin plastic material and may be removed once the frame molding has been hung. In a second embodiment, the frame molding may include an insert adapted to fit within the structure.

13 Claims, 3 Drawing Sheets

DECORATIVE FRAME MOLDING

BACKGROUND OF THE INVENTION

The present invention is directed toward a decorative frame molding and more particularly, toward a prefabricated frame molding that includes a self-leveling system.

Frame moldings are commonly used to decorate the walls, cabinets, doors, ceilings, and the like, of a home or office. Typically, a frame molding may be made from plastic, metal, wood, brass, copper, or the like. Any type of shape or design may be used. The frame is mounted to the surface desired and is held in place by nails, screws or other fasteners or some type of adhesive material. For example, U.S. Pat. No. 6,409,870 discloses a molding that may be used as a wall board or artistic border within a room, door frame, window frame, or furniture.

A problem, however, that is encountered when mounting or hanging a frame on a wall or other flat surface is that the frame needs to be centered or otherwise properly positioned and must be level. U.S. Pat. No. 5,848,489 to Hartley et al. addresses at least part of this problem. Hartley et al. disclose a level indicator recessed within the frame and is visible when viewing the front surface of the frame. A removable cover plate conceals the level indicator from view. However, Hartley et al. merely disclose a typical picture frame, it is not a frame molding that may be mounted to different types of flat surfaces. Furthermore, the picture frame of Hartley et al. does not have a decorative quality of its own. That is, a picture needs to be mounted within the frame in order to provide an aesthetically pleasing appearance. Also, the level is a permanent feature of the frame and there are no means disclosed for centering or otherwise properly positioning the frame.

U.S. Pat. No. 6,138,369 to Mushin discloses a level indicator for wall mounted fixtures or decorative objects. The level is movable from a visible position to a hidden position when not in use. This level, like the level disclosed in Hartley et al., is a permanent feature of the fixture. It may not be removed without destroying the fixture nor are there means for centering the frame.

Therefore, a need exists for a decorative frame molding that is easy to install and includes a removable leveling system.

SUMMARY OF THE INVENTION

The present invention is designed to overcome the deficiencies of the prior art discussed above. It is an object of the present invention to provide a decorative, prefabricated frame molding that is easy to install.

It is another object of the present invention to a decorative frame molding that includes a removable leveling system.

In accordance with the illustrative embodiments demonstrating features and advantages of the present invention, there is provided a decorative, prefabricated frame molding that includes a generally rectangular structure having a top, a bottom, a right side, a left side, a front side, and a back side. A recess is formed along the back side of the structure. A removable level with a first breakable length of material is secured between the top and the bottom and a second breakable length of material is secured between the right side and the left side of the frame so that the lengths intersect at their respective centers. The first and second lengths of material of the level are made from a thin plastic material. The structure may be mounted to a flat surface such as wall, a door, a cabinet, a ceiling, or the like. The recess includes means for securing the structure to the flat surface. The securing means may be an adhesive of any desired strength. That is, the adhesive must be strong enough to hold the frame molding against the flat surface but may be easily removable if the frame molding is intended to be a temporary fixture.

In a second embodiment, the frame molding may include an insert adapted to fit within the structure. The insert may be removed from the structure if desired. Also, the insert may include a recess in its back side into which an adhesive may be placed so that the insert adheres to the flat surface Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there are shown in the accompanying drawings forms that are presently preferred; it being understood that the invention is not intended to be limited to the precise arrangements and instrumentalities shown.

DETAILED DESCRIPTION OF THE PREFERRED EMBODIMENTS

Figure 2:
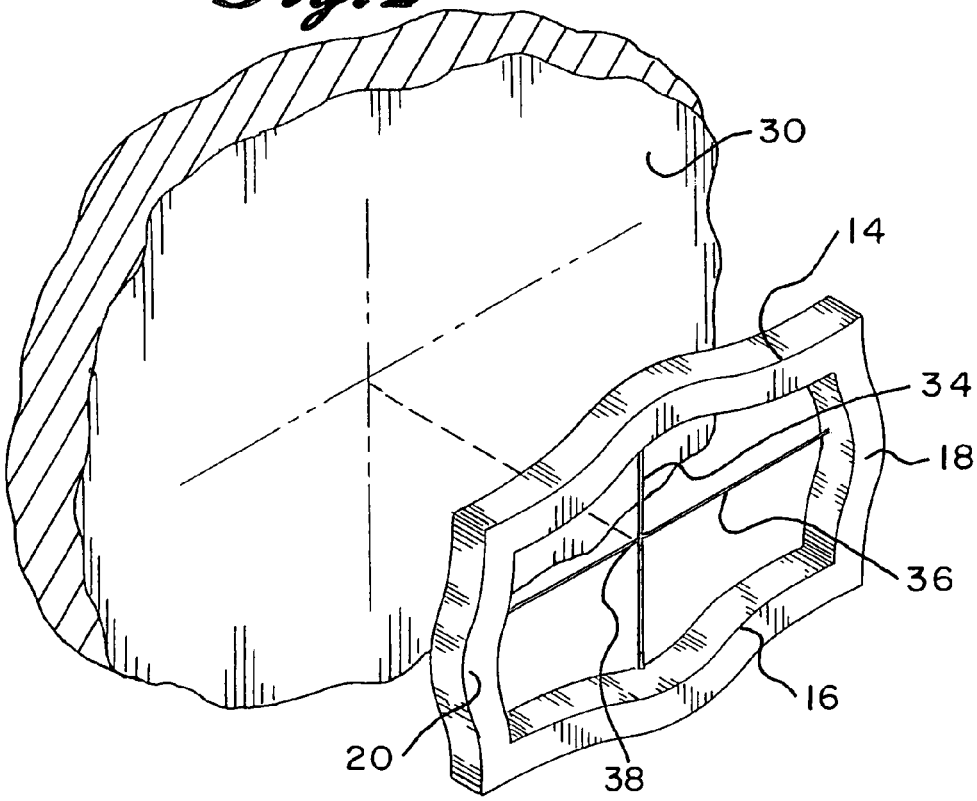
FIG. 2 is an exploded view of the first embodiment of the frame molding of the present invention.
Figure 4:
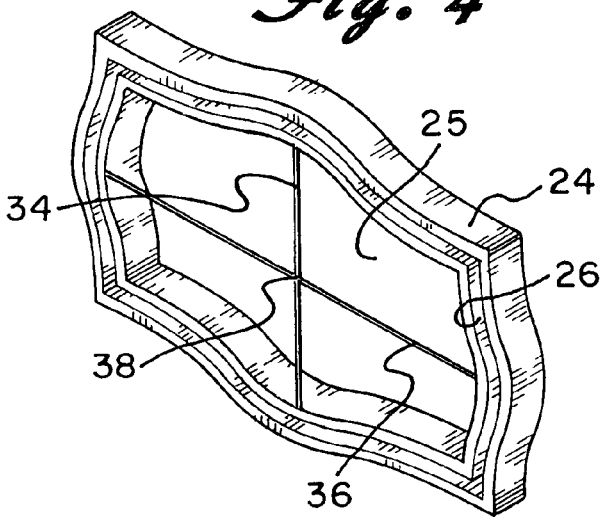
FIG. 4 is a rear perspective view of the first embodiment of the frame molding of the present invention.

Referring now to the drawings in detail wherein like reference numerals have been used throughout the various figures to designate like elements, there is shown in FIGS. 2 and 4 a decorative frame molding constructed in accordance with the principles of the present invention and designated generally as 10.

The prefabricated decorative frame molding of the present invention essentially includes a generally rectangular structure 12*a* or 12*b* having a top 14, a bottom 16, a right side 18, a left side 20, a front side 22, a back side 24, and a substantially hollow center 25. The structure 12 is preferably molded as one piece and may be made from polyurethane, polystyrene, or other suitable material.

Figure 3:
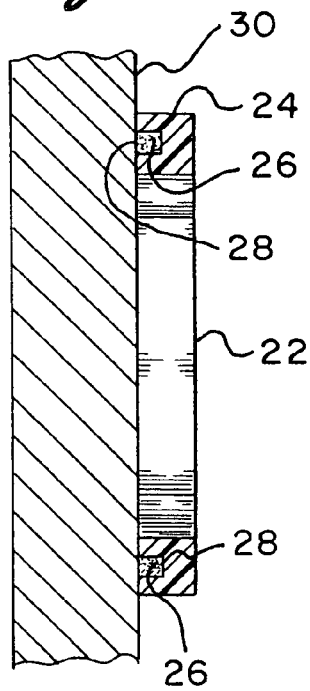
FIG. 3 is a cross-sectional view taken through line 3—3 of FIG. 1.

A recess 26 is formed along the back side 24 of the structure 12. (See FIG. 4.) The recess 26 includes means for securing 28 the structure 12 to a flat surface 30 such as wall, a door, a cabinet, a ceiling, or the like. The securing means 28 may be an adhesive material placed within the recess 26 in order to mount the frame molding flush to the flat surface 30. (See FIG. 3.) The adhesive may be of any desired strength, depending upon whether the frame molding is to be removably mounted to the flat surface or if it is to become a permanent fixture. In either case, the adhesive must be strong enough to be able to hold the frame molding against the flat surface.

Figure 5:
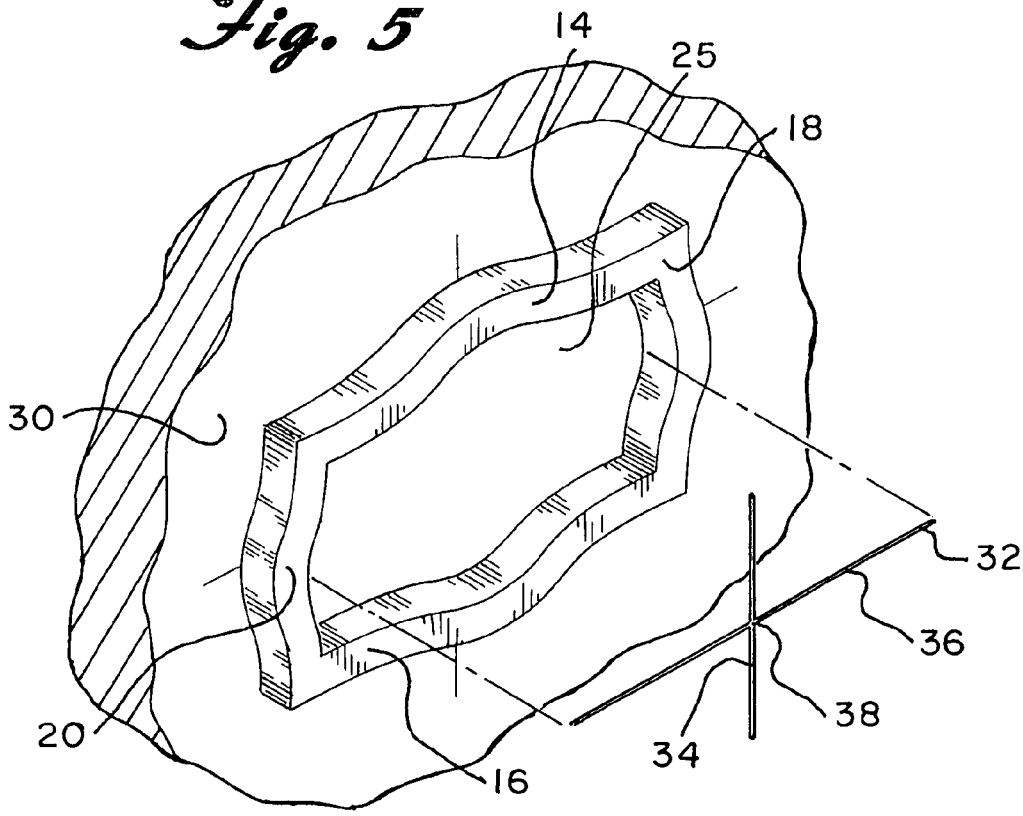
FIG. 5 is an exploded view of the first embodiment of the frame molding of the present invention.

The structure 12 also includes a removable centering and leveling system 32 having at least one breakable length of material. The leveling system 32 may include a first breakable length 34 of material secured between the top 14 and the bottom 16 of the structure 12 and a second breakable length 36 of material secured between the right side 18 and the left side 20 of the structure 12 so that the lengths 34 and 36 intersect at the center 38. (See FIG. 5.) The first and second lengths 34 and 36 of material of the level 32 are preferably made from the same plastic material as the main frame structure 12 and is also preferably molded simultaneously with the structure 12. The center 38 of the lengths 34 and 36 may be used to align or otherwise center the frame molding on the flat surface 30 (See FIG. 2) while the lengths 34 and 36, themselves, can be used for leveling. This can be accomplished by making appropriate markings on the wall 30 and aligning the lengths 34 and 36 with those markings. Once the frame molding has been placed on the flat surface correctly and leveled, the lengths 34 and 36 may be broken by simple tearing, ripping, or breaking them away from the structure 12.

Figure 6:
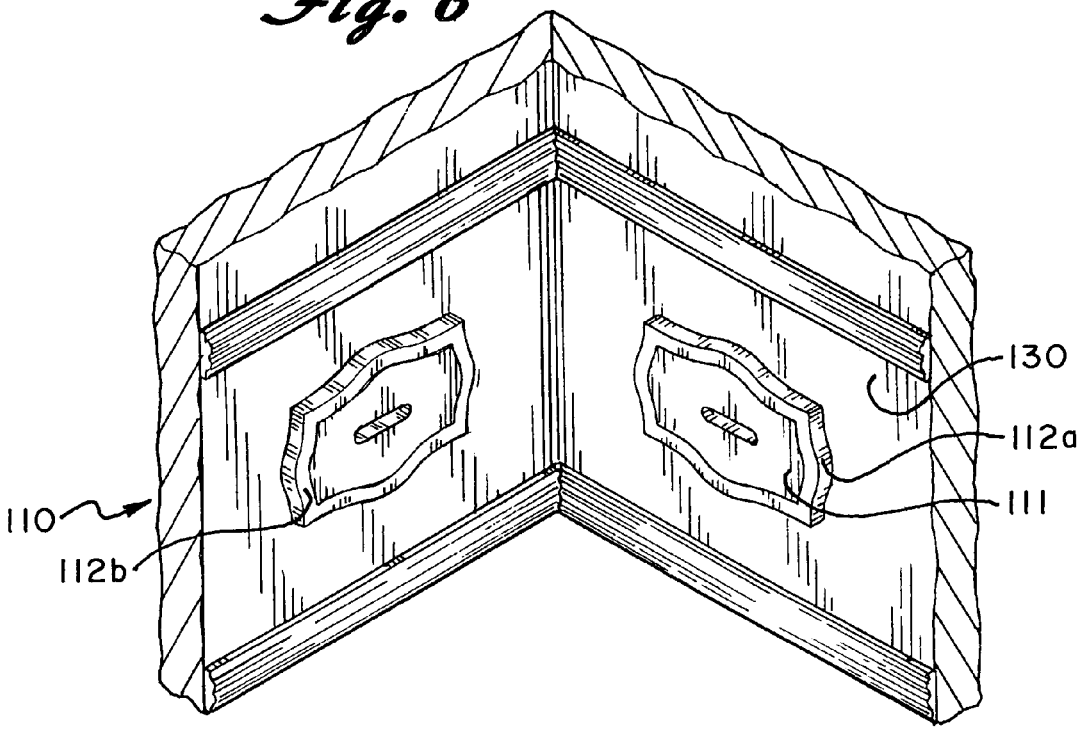
FIG. 6 illustrates a second embodiment of the frame molding of the present invention mounted on a flat surface.
Figure 7:
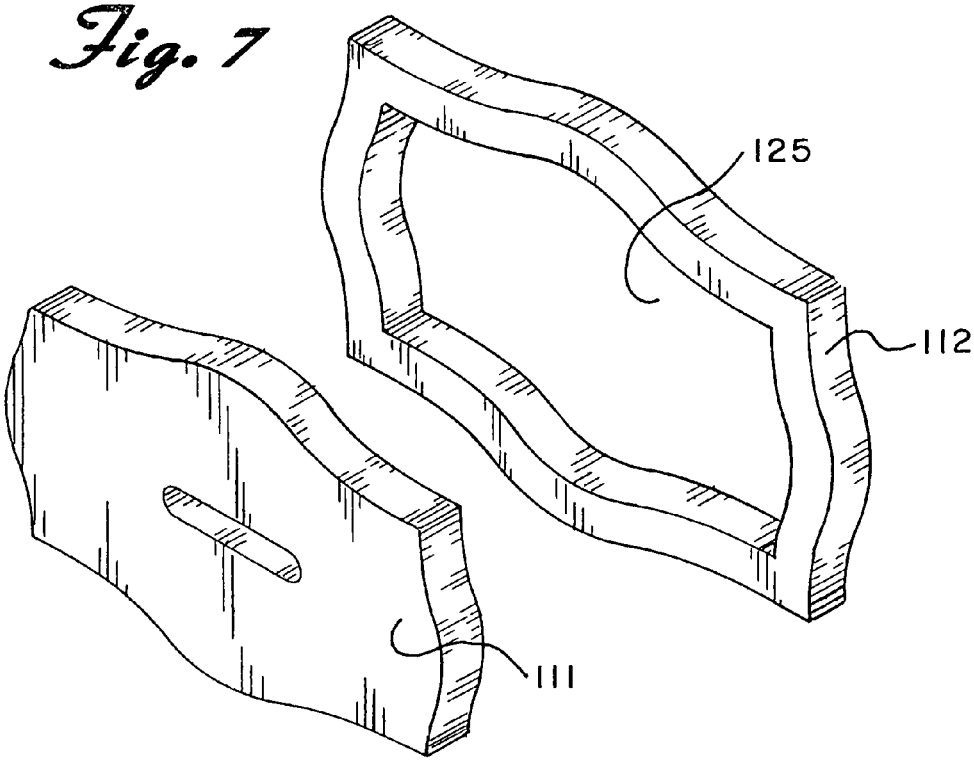
FIG. 7 is a front perspective view of the frame molding of the second embodiment of the present invention with the insert removed therefrom.

A second embodiment of the present invention is shown in FIGS. 6 and 7. The frame molding 110 of this embodiment functions in the same manner as the frame molding in the first embodiment. However, in this embodiment, the frame molding may include an insert 111 adapted to fit within the hollow center 125 of structure 112*a* or 112*b*. The insert 111 may have a recess formed along its back side so that it may also be secured to a flat surface 130. Alternatively, the insert 111 may simply be friction fit within the structure 112 so that the insert 111 may be removed as desired. (See FIG. 7.)

Figure 1:
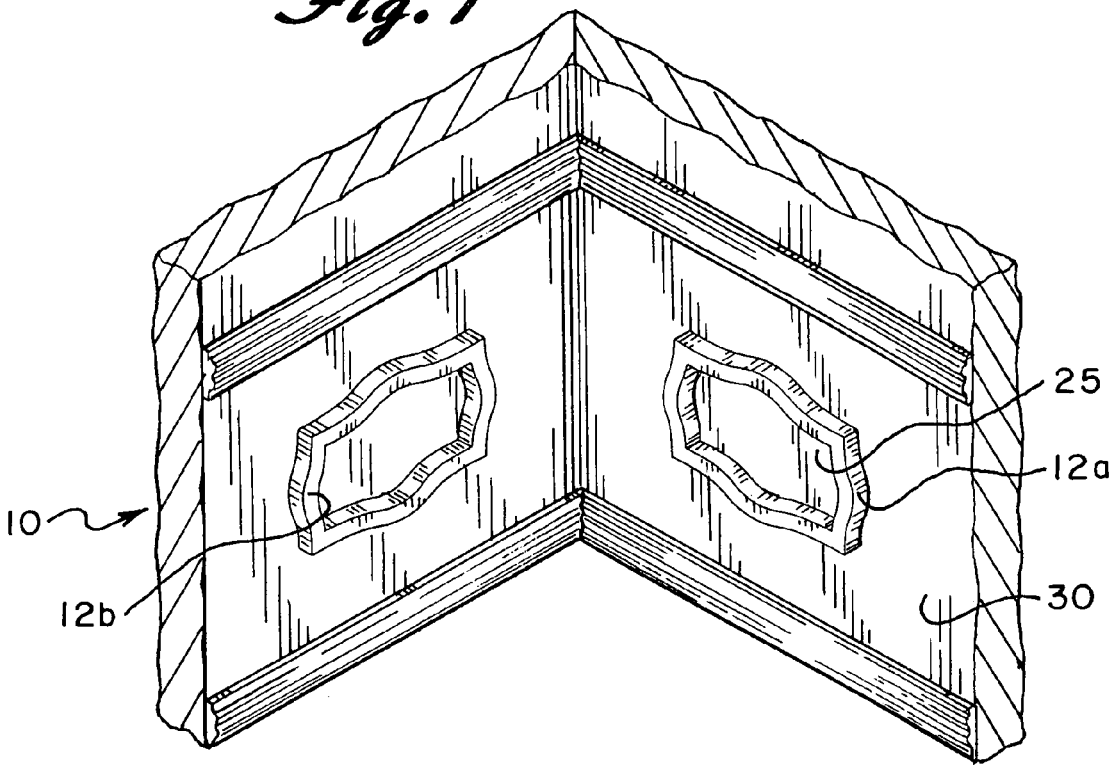
FIG. 1 illustrates a first embodiment of the decorative frame molding of the present invention mounted on a flat surface.

It should be realized that while only two embodiments have been shown, other shapes and sizes of the frame molding and insert are possible. Also, more than one frame molding may be mounted to a flat surface in a decorative manner as shown in FIGS. 1 and 6.

The present invention may be embodied in other specific forms without departing from the spirit or essential attributes thereof and accordingly, reference should be made to the appended claims rather than to the foregoing specification as indicating the scope of the invention.

I claim:

1. A decorative frame molding comprising:

a structure having a top, a bottom, a right side, a left side, a front side, and a back side;

a recess formed along said back side of said structure; and a removable level having at least one breakable length of material secured between either said top and said bottom of said structure or secured between said right side and said left side of said structure, wherein said structure is adapted to be mounted to a flat surface and said level is adapted to be broken away after said structure is mounted and said recess includes means for securing said structure to the flat surface.

2. The decorative frame molding of claim 1 wherein said removable level includes a first breakable length of material and a second breakable length of material, said first breakable length of material being secured between said top and said bottom of said structure and said second breakable length of material being secured between said right side and said left side of said structure.

3. The decorative frame of claim 2 wherein said first and second lengths of material of said level are made from a plastic material.

4. The decorative frame molding of claim 1 wherein said securing means includes an adhesive.

5. The decorative frame molding of claim 1 wherein all portions of said structure are substantially simultaneously molded from a plastic material.

6. The decorative frame molding of claim 1 further including an insert adapted to fit within said structure.

7. The decorative frame molding of claim 1 wherein said structure is generally rectangular.

8. The decorative frame molding of claim 1 further including an insert adapted to fit within said structure.

9. The decorative frame molding of claim 1 wherein said structure is generally rectangular.

10. A decorative frame molding comprising:

a structure having a top, a bottom, a right side, a left side, a front side, and a back side and a removable level having at least one breakable length of material secured between either said top and said bottom of said structure or secured between said right side and said left side of said structure, wherein said structure is adapted to be mounted to a flat surface and said level is adapted to be broken away after said structure is mounted and all portions of said structure are substantially simultaneously molded from a plastic material.

11. The decorative frame molding of claim 10 wherein said removable level includes a first breakable length of material and a second breakable length of material, said first breakable length of material being secured between said top and said bottom of said structure and said second breakable length of material being secured between said right side and said left side of said structure.

12. The decorative frame of claim 11 wherein said first and second lengths of material of said level are made from a plastic material.

13. The decorative frame of claim 10 further including a recess formed along said back side of said structure.

* * * * *